United States Patent [19]
Thayer et al.
[11] 4,451,824
[45] May 29, 1984

[54] COLOR CONVERGENCE DATA PROCESSING IN A CRT COLOR DISPLAY STATION

[75] Inventors: David J. Thayer, Elgin; James J. Krause, Hanover Park; John R. Welk, Addison, all of Ill.

[73] Assignee: Motorola, Inc., Schaumburg, Ill.

[21] Appl. No.: 390,580

[22] Filed: Jun. 21, 1982

[51] Int. Cl.[3] ..... G09G 1/00

[52] U.S. Cl. ..... 340/720; 340/732; 340/789; 313/412; 313/428; 315/13 C; 315/368

[58] Field of Search ..... 340/701, 703, 720, 732, 340/789; 358/65; 313/412, 428; 315/13 C, 368

[56] References Cited

U.S. PATENT DOCUMENTS

| | | | |
|---|---|---|---|
| 3,603,962 | 9/1971 | Lechner . | |
| 3,800,176 | 3/1974 | Gross et al. | 313/412 |
| 3,996,585 | 12/1976 | Hogan et al. . | |
| 4,155,095 | 5/1979 | Kirschner | 358/82 |
| 4,158,837 | 6/1979 | Zahorsky . | |
| 4,172,309 | 10/1979 | Chiodi | 315/368 |
| 4,189,659 | 2/1980 | Andre et al. | 313/412 |
| 4,200,867 | 4/1980 | Hill | 340/703 |
| 4,203,051 | 5/1980 | Hallett et al. | 315/13 C |
| 4,203,054 | 5/1980 | Sowter | 315/13 C |
| 4,217,577 | 8/1980 | Roe et al. . | |
| 4,232,311 | 11/1980 | Agneta | 340/703 |
| 4,291,256 | 9/1981 | Garwin | 315/13 C |

OTHER PUBLICATIONS

IBM Technical Disclosure Bulletin, vol. 22, No. 5, Oct. 1979, A. S. Murphy, "Automatic Digital Convergence Using a Read Gun", pp. 2111–2112.

Article entitled "Digital System for Convergence of Three Beam High Resolution Color Data Displays", by Beeteson et al., IBM J. Res. Devolop., vol. 24, No. 5, 1980, pp. 598–611.

IBM 3270 Information Display System: Color and Programmed Symbols Manual, (1979), Cover Page through Chapter 3 and p. 5-1.

IBM 3270 Information Display System, 3274 Control Unit Manual (1981), Various Pages.

IBM 8100 Information System Manual, (1980), Various Pages Including Appendix A.

Pages 22.3 and 22.4 from an IBM Appendix A5, from IBM 3274, 3276 Control Unit to Device Product Attachment Information, (Oct. 1977).

Panasonic Color CRT Advertisement.

*Primary Examiner*—Gerald L. Brigance
*Attorney, Agent, or Firm*—Phillip H. Melamed; James W. Gillman; James S. Pristelski

[57] ABSTRACT

A preconverged color display station is disclosed which is compatible with a computer controlled control unit that provides electrical convergence control signals. Compatibility is obtained by causing the control unit to transmit the electrical convergence signals to the screen storage memory RAM (random access memory) which normally stores information defining the character and character attributes to be visually provided by the display station CRT screen. The stored convergence signals are read back to the control unit from the screen RAM. After all of the convergence signals have been received by the display station and prior to the transmission of character and character attribute information signals to the screen RAM, the contents of the screen RAM is erased. Subsequently, the contents of the screen RAM, which now contains character display information signals, is read out and utilized to define a visual display on a CRT. During the time that the screen RAM contains electrical convergence signals, the video of the CRT is blanked. Selection of any of at least three basic colors is provided by the color display station whether or not electrical convergence control signals are provided thereto and whether or not a monochrome or multicolor control unit is coupled thereto.

16 Claims, 3 Drawing Figures

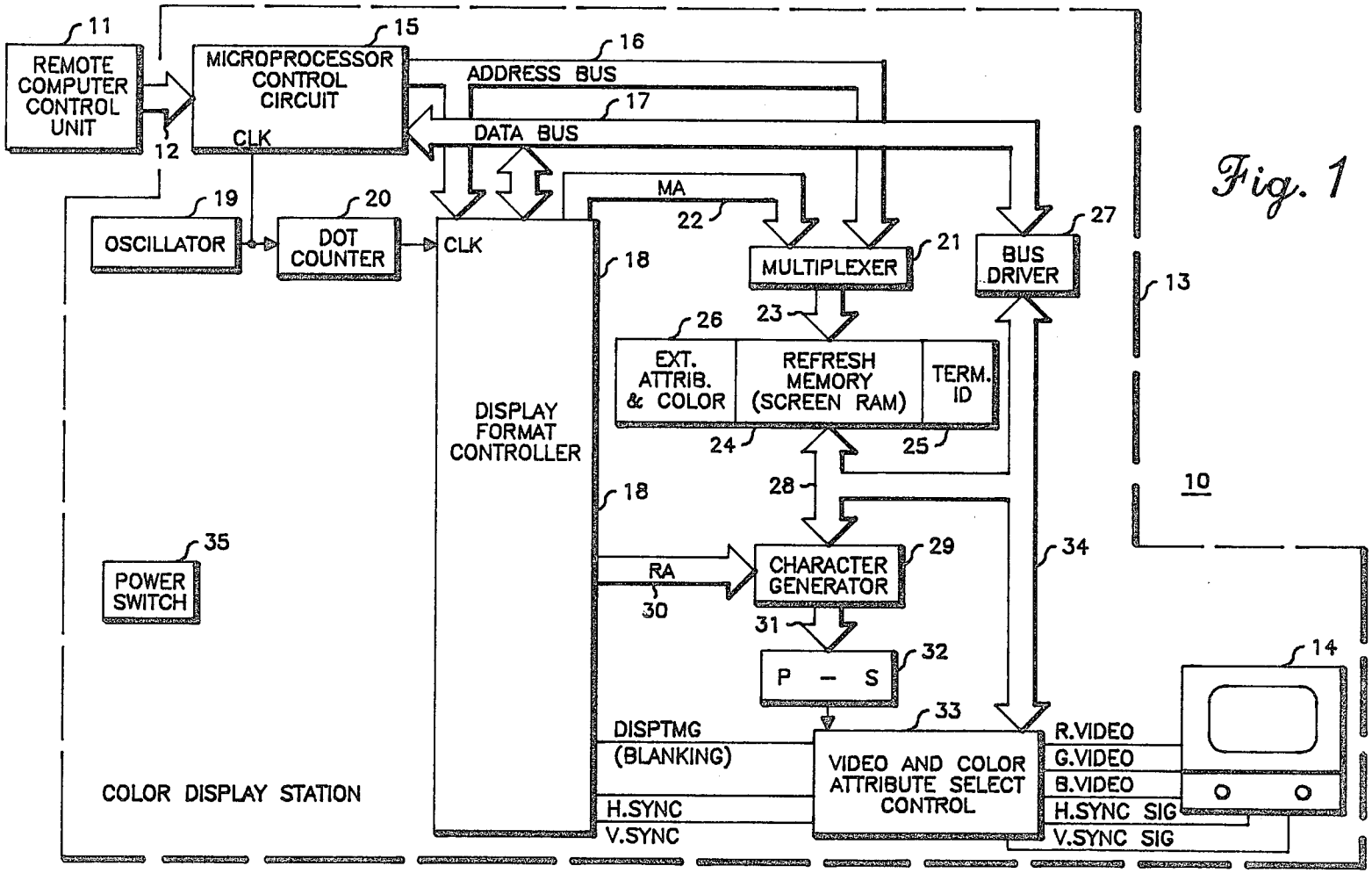
Fig. 1
10
13
14
R.VIDEO
G.VIDEO
B.VIDEO
H.SYNC SIG
V.SYNC SIG
27
BUS DRIVER
34
VIDEO AND COLOR ATTRIBUTE SELECT CONTROL
21
MULTIPLEXER
TERM. ID
25
REFRESH MEMORY (SCREEN RAM)
29
CHARACTER GENERATOR
32
P — S
33
23
28
31
26
EXT. ATTRIB. & COLOR
24
22
MA
RA
30
DISPTMG
(BLANKING)
H.SYNC
V.SYNC
16
ADDRESS BUS
17
DATA BUS
18
18
DISPLAY FORMAT CONTROLLER
CLK
15
MICROPROCESSOR CONTROL CIRCUIT
CLK
20
DOT COUNTER
19
OSCILLATOR
12
11
REMOTE COMPUTER CONTROL UNIT
35
POWER SWITCH
COLOR DISPLAY STATION

COLOR CONVERGENCE DATA PROCESSING IN A CRT COLOR DISPLAY STATION

CROSS REFERENCE TO RELATED APPLICATIONS

The present invention is related to the invention described in copending U.S. patent application Ser. No. 390,581 entitled "Multicolor Display from Monochrome or Multicolor Control Unit", by John Robert Welk, filed 06/21/82, and assigned to the same assignee as the present invention.

BACKGROUND OF THE PRESENT INVENTION

The present invention is related to CRT information display systems and more particularly to color display stations (terminals) which are used in such display systems. The term "color" is used herein to designate multicolor capability of providing at least three distinct color hues.

Typically in CRT information display systems, a remote computer acts through a computer controlled control unit, which may be a microprocessor (MPU), to provide information and control signals to a CRT display station and this results in the production of a visual image on a CRT screen. For a color display information system such as the IBM 3270 system, the IBM control unit 3274 with IBM configuration support C, or its equivalent, if it identifies that it is connected to an appropriate IBM color display station such as a 3279, will initially transmit electrical convergence control signals to the display station since the convergence of the color beams in the IBM display station 3279 is controlled by electrical convergence signals received from the control unit. U.S. Pat. Nos. 4,203,051 and 4,203,054 relate to this convengence control system. After the control unit has transmitted these convergence control signals to the display station, and after the control unit has read back information concerning these signals to verify their receipt, then the control unit proceeds to transmit character display information to the display station wherein the character display information includes character attribute information such as the color of the character to be produced. Under some conditions extended attribute and color information is also provided to the display station if the control unit recognizes the display station as a color station having this capability.

The above identified system requires that the control unit transmits convergence data and that this data is subsequently read back to the control unit prior to the transmission of character display data and extended attribute data. If the electrical convergence signals are not properly read back by the control unit, the control unit will not implement any extended attribute characteristics and the control unit will cease to send display information and a desired visual display will not be provided.

In the display system described above, the convergence signals are stored in the display station since their presence is required to implement control of beam convergence circuitry located in the display station. In addition, provision is also made for operator adjustment of the stored convergence control signals so as to enable the operator to adjust the display station beam convergence. The entire operator convergence procedure is complex and tends to confuse operators of the display station. In addition, the operator convergence procedure is time consuming. Also extensive storage space must be provided in the display station for the convergence signals. For these reasons the present invention differs from the prior system in that it contemplates a preconverged CRT which utilizes factory preadjusted mechanical convergence control apparatus. This completely eliminates the need for the electrical convergence signals sent by the display system control unit. However, as previously noted, the receipt, storage, and subsequent read back of these convergence signals is still required for proper operation of the display system when a preconverged display station is used in an IBM 3270 system.

SUMMARY OF THE PRESENT INVENTION

An object of the present invention is to provide a CRT display system which utilizes a preconverged CRT display station but is still fully compatible with display control units that transmit and read back electrical convergence control signals.

In one embodiment of the present invention a CRT information display system is provided in which a CRT display station receives electrical convergence control signals from a control unit, effectively stores them and then allows the reading back of the stored convergence control signals. In such a display system a screen display RAM is provided for receiving and storing video character control signals which define a video character pattern to be visually displayed on the CRT. The present invention comprises an improvement in the above-described system comprising the combination in said display station of: a preconverged CRT on which a video character pattern is to be displayed, means for receiving and storing electrical convergence control signals in predetermined storage locations in the display station while preventing said stored convergence control signals from effectively controlling the convergence of said CRT, means for receiving and storing said video character control signals in predetermined storage locations in said screen RAM, and means for providing a predetermined visually displayed character pattern on said CRT in accordance with said stored video character control signals while effectively preventing said stored convergence control signals from controlling convergence of said CRT.

Essentially, the present invention contemplates the use of predetermined storage locations in the display station for storing received electrical convergence control signals until at least these signals are read back by a display control unit. The storage locations may comprise locations in the screen display RAM which normally receive and store video character control data, in which case the convergence control signals are only temporarily stored in these locations. If the convergence storage locations are normally used to receive video character control data, then during the storage of convergence data in these locations, no video pattern is provided on the CRT screen due to the effective disconnection of the screen display RAM to the CRT screen. This can be implemented by blanking the CRT video while the screen RAM contains electrical convergence control signals instead of video character control signals. In some instances this blanking may not be necessary. Also the present invention may utilize non-displayable attribute storage locations in the screen RAM, rather than video displayable locations in the screen RAM. In addition, storage locations separate from the screen RAM can be used. In all instances signals in these convergence signal storage locations are prevented from affecting the convergence of the preconverged CRT.

Through the use of the present invention, not only is a preconverged CRT display station made compatible with a display control unit intended to control an electrically controllable convergence display station, but no additional memory storage locations may be required to implement this compatibility since the existing screen display RAM locations can be utilized for the temporary storage of the electrical convergence control signals. Also, the complex and time consuming manual operator adjustment of convergence is eliminated while the display station of the present invention is fully compatible with the existing control units that require the receipt, storage and read back of electrical convergence control signals.

BRIEF DESCRIPTION OF THE DRAWINGS

For a more complete understanding of the present invention, reference should be made to the drawings in which:

FIG. 1 is a schematic block diagram of a CRT information display system incorporating the present invention; and FIGS. *2a* and *2b* comprise an information flowchart diagram which illustrates the operation of the information display system shown in FIG. 1.

DESCRIPTION OF THE PREFERRED EMBODIMENT

Figure 2A:
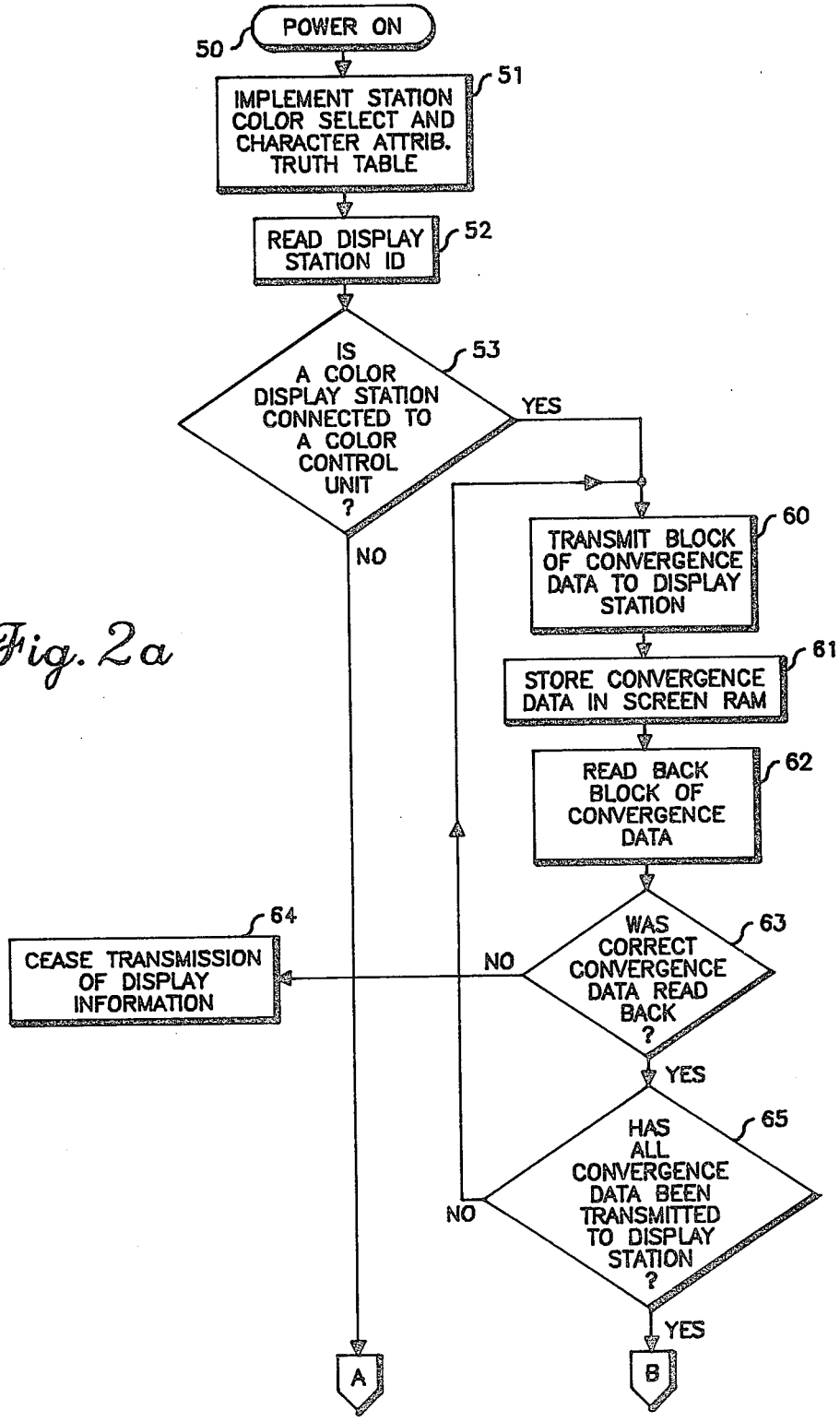

FIG. 1 illustrates a display information system 10 in which a remote computer control unit 11 is contemplated as supplying display information via a coaxial cable 12 to a color display station 13 (shown dashed) which includes a CRT (cathode ray tube terminal) 14 and a programmed microprocessor control circuit (MPU) 15. It is contemplated that the remote computer control unit 11 can either correspond to an IBM color control unit 3274 which is used to control an IBM color display station 3279, or equivalents of the IBM 3274 control unit, or other either monochrome or color control units which may or may not provide electrical convergence control signals. The color display station 13 of the present invention is intended to be compatible with the IBM 3274 control unit with IBM configuration support C which does provide electrical convergence control signals, and with other control units which do not.

The control unit 11 is contemplated, when this unit corresponds to the IBM 3274 with IBM configuration support C, as initially providing electrical convergence control signals to the display station 13, requiring the read back of these signals by the control unit 11, and then sequentially providing visual display information signals to the station 13 to provide a desired color visual display. Essentially the present invention provides the display station 13 with the ability to convince the control unit 11 that it is correctly connected to a compatible IBM display station, such as the IBM 3279. The manner in which this is accomplished will now be discussed.

The information cable 12 from the computer control unit 11 couples information to the microprocessor control circuit 15 which is contained within the display station 13. This control circuit is programmed to process information received via the cable 12 and provide corresponding desired display and control information on an address bus 16 and a data bus 17. The address bus 16, besides being directly connected to the MPU 15 is also connected as supplying some of the control inputs to a display format controller 18 which corresponds to either the Motorola display format controller MC6845 or the Hitachi display format controller HD46505R. Preferably the MPU 15 comprises a general purpose programmed microprocessor comprising an Advance Micro Devices (AMD) 2910 sequencer and two AMD 2901 arithmetic logic units, plus several read only memory (ROM) devices and associated circuitry.

A high frequency oscillator 19 provides a fixed frequency output signal to a dot counter 20 which essentially comprises a frequency divider. The output of the oscillator 19 may also be coupled as the clock rate input to the microprocessor control circuit 15. The output of the dot counter 20 essentially corresponds to a character clock signal which is supplied to an input clock terminal CLK of the display format controller 18. This configuration is standard and illustrates that the character clock signal provided by the dot counter 20 controls the timing produced by the display format controller 18 in conjunction with control signals received from the microprocessor 15 via the address bus 16 or the data bus 17.

The address bus 16 is also coupled as an input to a multiplexer circuit 21 which receives another input address signal via a memory address bus (MA) 22 provided as one of the primary outputs of the display format controller 18. The operation of the multiplexer 21 is controlled by the MPU control circuit 15 which effectively tells the multiplexer 21 which of the two address information inputs should be provided as the address output of the multiplexer which is provided on a bus 23. The bus 23 is directly coupled as an input to a refresh memory circuit 24 which is also referred to as the character screen RAM since this element normally stores character identification data (video character control signals) which define the visual display to be produced. The character identification data can include character definition data which would define display characters such as alphabetics or numerics, as well as character attribute data which could indicate that the character to be visually displayed should be displayed at either an intensified or normal video level for monochrome operation of the display station 13, or that the character should be displayed in any one of a number of selectable colors for color operation of the display station. Additional character attribute data which can be stored in the screen RAM comprises whether or not the character to be displayed is light pen detectable or not and if the character field to be displayed is protected or unprotected, wherein unprotected means that the display station operator can directly alter the character being displayed.

In addition to having the character information storage capabilities described above, the refresh memory screen RAM 24 can also be considered as contaning one fixed storage location 25 which contains data that identifies the type of display station (terminal) corresponding to the display station 13. This terminal ID location 25 could alternatively consist of a storage location contained in the microprocessor control circuit 15. In addition, the refresh memory screen RAM 24 also has additional storage capability locations 26 for storing extended attributes including extended color control signals which would include storing control data for implementing the selection of colors in addition to the basic colors of red, green, blue and white. It should be noted that the extended attributes, in addition to extended color, may comprise underline, reverse video, blinking and programmable symbol selection. It is contemplated that these extended attribute and color select locations 26 contain stored control data only when such extended data is sent by the control unit 11 through the MPU 15 to the screen RAM 24. It should be noted that if the control unit 11 does not identify the color display station 13 as being compatible, no extended color attribute data will be sent to the MPU 15, and therefore no extended color selection will be possible.

It should be noted that the data bus 17 is bidirectionaly coupled to a bus driver 27 that is bidirectionally coupled to the screen RAM 24. The bus driver 27 permits the loading of information data into the screen RAM 24 from the microprocessor 15 at addresses defined by the information on the address bus 16. This configuration also permits the reading out of the contents of the screen RAM 24 on the data bus 17 in accordance with what address is being provided via the bus 16 to the screen RAM.

The data output of the screen RAM 24 is provided via a bus connection 28 as an input to a character generator 29 which receives raster address information via a raster address bus (RA) 30 coupled between the format controller 18 and the character generator 29. The output of the character generator 29 represents specific character identification signals provided in accordance with the data received via the buses 28 and 30 wherein this character identification information actually comprises raster scan array data defining an array of dots defined by the data supplied to the character generator 29. The output information of the generator 29 is contemplated as being supplied via a parallel data information bus 31 to a parallel to serial information converter 32 that supplies serial raster dot information as an input to a video and color and attribute select control circuit 33. The circuit 33 also receives horizontal and vertical sync signals from the format controller 18, as well as receiving a display timing signal (DISPTMG) which effectively defines the blanking period for video output signals provided by the control circuit 33.

It is contemplated that the video and color attribute select control circuit 33 receives color and attribute select information signals via a bus connection 34, and this connection could connect to attribute and/or color select decoder logic contained within the video control circuit 33. The control circuit 33 provides separate red, green, and blue video excitation signals to the CRT 14, which video excitation signals can be provided either singly or in combination to implement basic or extended color selection, respectively. The circuit 33 also provides horizontal and vertical sync signals to the CRT 14. Blanking of video is provided in accordance with the DISPTMG signal. Also video blanking can be controlled by the display system in accordance with other control signals. A power-on switch 35 is provided in the color display station 13, and when activated it supplies operative power to the electrical components in the display station including the microprocessor 15 and CRT 14.

Essentially, the normal operation of the color display station 13 is such that information concerning the type of visual display to be provided is supplied through the multiplexer 21 and bus driver 27 to the refresh memory circuit (screen RAM) 24 where the main storage locations of this circuit store information concerning the visual display to be produced. Subsequently, the display format controller 18 takes over and essentially, by means of the memory address bus 22, the controller 18 reads out the data stored in the screen RAM and supplies this data to the character generator 29. The generator 29, as previously noted, in conjunction with the raster address information supplied on the bus 30, provides raster scan character definition signals to the video control circuit 33 which in turn controls raster scanning of electron beams in the CRT 14 to implement the desired visual display in the colors and attributes selected by the color select and attribute select information provided via the bus 34 from memory locations 26 and 24.

Extensive publicly available information exists on basic raster scanning CRT display stations which generally operate in accordance with the preceding description. Thus details concerning the operation of the display format controller 18, the multiplexer 21, the screen RAM 24, the character generator 29, the parallel to serial converter 32 and video control circuit 33, do not need to be discussed in detail since the operation of these elements is generally well known to those of average skill in the art. Extensive literature exists describing the operation of each of these elements.

As previously noted, one feature of the present embodiment is to provide the color display station 13 with compatibility with an electrical convergence control unit such as the IBM 3274 when such a unit corresponds to the control unit 11. This can best be illustrated by referring to the flowchart shown in FIGS. 2*a* and 2*b* which is representative of the information flow steps that occur due to the programming of the microprocessor control circuit 15 and the operation of control unit 11. Essentially the preferred embodiment of the present invention represents specific programming of the microprocessor control circuit 15 so as to process the display information received on the cable 12 and thereby implement compatibility of the color display station 13 with the control unit 11. This is accomplished in the following manner.

Figure 2B:
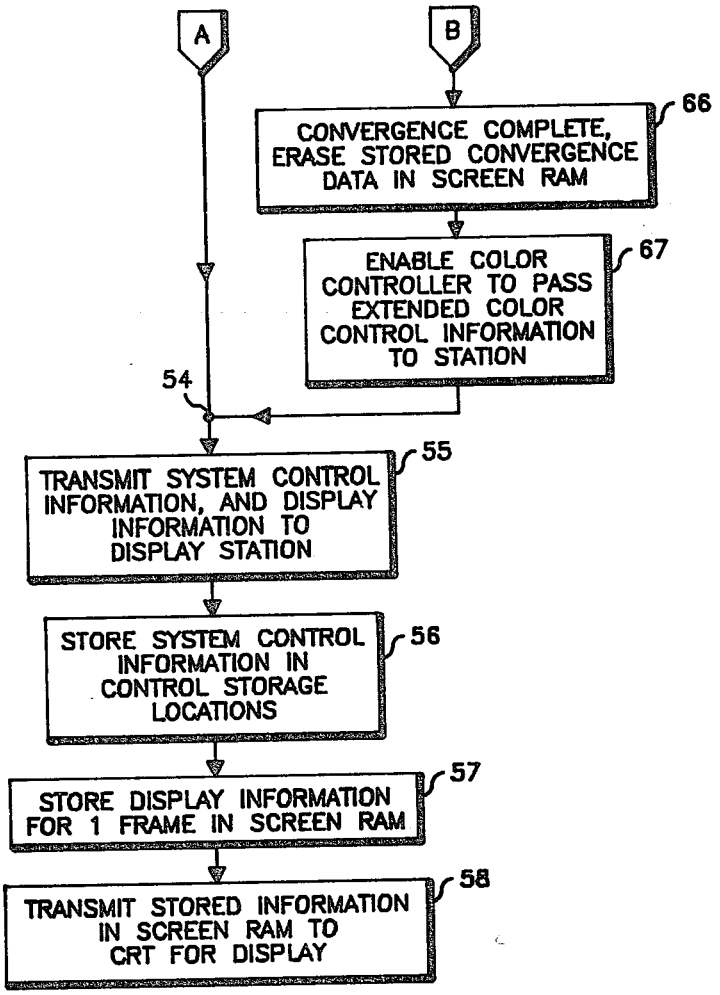

Referring to FIGS. 2*a* and 2*b*, the flowchart is entered in response to activation of the power on switch 35. This results in the immediate effective implementation of a display station color select and character attribute truth table by the microprocessor control circuit 15. What this means is that in response to certain information signals supplied on the coax cable 12, the microprocessor 15 will interpret these signals as requests for the generation of specific character attributes and color select attributes, regardless of whether or not the control unit 11 is a color or monochrome control unit, and regardless of whether or not the control unit 11 transmits electrical convergence data to the display station 13. The actual truth table comprises fixed logic circuits in the video control circuit 33.

This can best be understood by noting that in the IBM 3270 system, various combinations of intensified or normal intensity and protected and unprotected character field attributes are interpreted as selecting any of the four basic colors of red, green, blue or white. However, in the IBM 3270 system, this is only provided if the control unit recognizes that it is connected to a color display station which has received and properly stored the electrical color convergence signals that were transmitted to it. In all other situations, the IBM 3279 display station will provide a monochrome (green only) display and merely directly interpret the monochrome character attribute codes of intensified, non-intensified, protected and unprotected. The present embodiment differs from the IBM system in that in response to the application of power to the display station 13 certain character attributes still result in the production of a multicolor display regardless of what type of control unit supplies data information to the display station 13.

The video control circuit 33 actually implements the color selection for the character definition signals recieved from the character generator 29 via select signals on the bus 34. The truth table implemented by the present invention is the same as that provided in the IBM 3270 system, but this feature is now implemented any time the display station 13 is operative rather than only if the control unit identifies the display station as a compatible color display station.

The color select truth table provides for interpreting the combination of unprotected, intensified and light pen detectable field attributes as red; protected, intensified and light pen detectable field attributes as white; unprotected and normal intensity fields as green; and protected and normal intensity fields as blue. This is generally explained in publications on the IBM 3270 system. The truth table can be readily implemented by combinational logic in the video contol 33, or by fixed programming of the microprocessor 15. Thus the present invention implements a multicolor visual display even when the color display station 13 is connected to a monochrome control unit 11.

The above operation for color selection is illustrated by the initializing power on step 50 in the flowchart in FIGS. 2*a* and 2*b* which step is then followed by the process step 51. After implementing the process step 51, information flow passes to a process block 52 wherein the display station identification (ID) code is effectively read by the control unit 11. This essentially corresponds to the microprocessor 15 reading out data, in response to a command from the control unit 11, from a designated storage location (location 25) wherein this data identifies to the control unit 11 the type of display station that the control unit 11 is connected to. To insure compatibility with the IBM 3270 system, the ID data stored in location 25 corresponds to data identifying the display station 13 as an IBM 3279 display station. This ID data is supplied by the microprocessor 15 to the control unit 11.

From the process block 52, information passes to a decision block 53 wherein the computer control unit 11 determines if the control unit 11 is a color control unit and if the control unit is connected to a proper color display station. If either the control unit 11 is not a color control unit, or if the control unit 11 determines that the display station identification does not correspond to a proper color display station ID, then the process flow directly proceeds to a terminal 54. From the terminal 54 information flow proceeds to a process block 55 which corresponds to the control unit 11 transmitting system control information and character display information to the display station 13 via the cable 12. Information flow then proceeds to a process block 56 which corresponds to the storing of system control information in control storage locations. From block 56 information flow passes to process block 57 that corresponds to the storage of character display information in the refresh memory screen RAM 24, wherein it should be noted that one frame of display information can be stored in the screen RAM prior to the read out of information from the RAM by the controller 18. Actually all characters are displayed as they are entered in the screen RAM on a character by character basis. From the process block 57 information flow passes to the process block 58 which corresponds to the read out of the stored character information in the screen RAM 24 to the CRT 14 on which the visual display is provided.

The operation of all of the process blocks 55 through 58 is conventional and well known to those of average skill in the art and therefore will not be discussed in detail. However, it should be noted that because the present embodiment has implemented process block 51 prior to the terminal 54, normal monochrome character attribute information which is stored in the screen RAM 24 may result in the selection of any of at least three colors. In the prior IBM 3279 display station, a multicolor visual display can only be provided after the IBM color control unit 3274 with configuration support C has received confirmation that electrical convergence signals have been received and properly stored by the IBM display station 3279.

In the present invention, if the decision block 53 determines that the control unit 11 is a color control unit, and that the color control unit is connected to what it believes to be a proper color display station, then information flow passes to a process block 60 which corresponds to the control unit 11 transmitting electrical convergence data via the cable 12 to the display station 13. It should be noted that this corresponds to the operation of the IBM 3270 system and the operation of the IBM 3274 control unit with IBM support configuration C. Typically the convergence data is transmitted in a sequence of blocks of convergence information.

After the process block 60, information flow continues to a process block 61 which corresponds to the storing of the electrical covergence data received by the display station 13 in the screen RAM 24. It should be noted that either video displayable or video non-displayable (attribute) storage locations in the screen RAM 24 can be utilized, or the extended attribute and color select screen RAM storage locations 26 can be utilized. Alternatively a separate memory storage device could be utilized instead of the screen RAM 24, if that is desired. This storage step corresponds to the MPU control circuit 15 altering the transmitted address information for the convergence data sent by control unit 11 such that the data is now stored in memory locations corresponding to predetermined memory locations in the display station 13. During this time, it should be noted that the microprocessor circuit 15 also effectively controls the display format controller 18 and video control circuit 33 so as to provide for video blanking during the storage of this data in the screen RAM. This latter operation can be readily implemented by merely forcing the display format controller 18 to provide a video blanking signal in response to a logic signal from the MPU 15. This signal can correspond to the non-select logic signal provided to the controller 18 when operation of this device is not desired by the MPU 15. This latter feature prevents any stored convergence data in the video displayable portions of the screen RAM 24 from effectively defining a visual display on the CRT screen of the terminal 14 during the temporary storage of the convergence data in the screen RAM. Thus the display station 13 may effectively disconnect the screen RAM 24 from control of the CRT visual display during the time that video displayable portions of the screen RAM store convergence data. In some instances blanking the CRT video may not be necessary, such as if the convergence control signals are stored in video non-displayable storage locations.

From the process block 61 information flow passes to a process block 62 which corresponds to the read out of the stored convergence data by the control unit 11. Again the MPU 15 retranslates the address of the convergence data which is being read out to the control unit 11 such that the control unit 11 believes that the read back convergence data is stored in the proper convergence storage locations.

The determination by the control unit 11 that the proper convergence data was read back is made by a decision block 63 which follows the process block 62. This decision is made by the control unit 11. If there is an error in reading back the convergence data, it is contemplated that either the control unit 11 or the microprocessor 15 may erase any of the stored convergence data that was received by the display station via a process block 64, and then the control unit 11 will cease transmission of display information to the display station 13 since the display station has been identified as being either non functional or non-compatible with the control unit 11. Alternatively, it could be provided for the attempted retransmission and restorage of the convergence data by the control unit 11 and this could be attempted a number of times before the control unit 11 gives up, assuming that proper read back of the convergence data is never achieved.

As long as decision block 63 continues to identify that the electrical convergence data has been properly read back, control will continue to pass to a decision block 65 which inquires if all of the desired convergence data has been transmitted by the control unit 11 and properly read back by the control unit 11. If not, the next block of convergence data will be transmitted by information flow passing again to the process block 60.

Once all convergence data has been properly transmitted to the display station and properly read back to the control unit 11, then control passes from the decision block 65 to a process block 66 which essentially corresponds to the recognition of the completion of the transmission and storage of all of the electrical convergence data. Process block 66 also then implements the erasing of all of the stored convergence data which is being held in the screen RAM 24. This corresponds to a standard computer subroutine implemented by the microprocessor 15 which merely addresses all of the storage locations in the display station 13 that were addressed for storage of convergence information, and rezeros all of these locations. This is desired since this will prevent any of the electrical convergence data from affecting the visual display to be provided by the CRT 14, especially since the data contained in the screen RAM 24 typically defines the visual characteristics of the display to be provided by defining both the characters to be displayed and the visual attributes of these characters.

It should be noted that video blanking may not be necessary if the convergence control signals are stored in non-displayable storage locations in the screen RAM 24, or if an auxiliary storage device is used to store the convergence signals. In the latter case it may not be necessary to erase the stored convergence control signals. In all cases effective control of convergence by the stored convergence control signals is prevented by never providing a convergence control path for these signals to the preconverged CRT 14.

From the process block 66, information flow passes to a process block 67 which corresponds to the control unit 11 recognizing that all convergence data has apparently been transmitted and properly stored by the display station 13 such that convergence of the color beams is now assured due to the apparent effect of the stored control signals. In actuality, convergence of the CRT 14 is determined by mechanical factory adjustments and not in accordance with any electrical convergence control signals received from the control unit 11. However, the present invention has provided data to the control unit 11 which makes the control unit beleive that it is connected to a compatible display station which is utilizing the convergence control signals that the control unit has supplied. According to process block 67, recognition by the control unit 11 that the convergence signals have been properly received and stored by the display station 13, results in the control unit 11 providing basic color and extended color select information, among other extended attribute signals, to the color display station 13. These extended attribute signals are stored in locations 26. Obviously the extended color information would be unnecessary if the display station 13 were not recognized by the control unit 11 as a properly converged color display station. In that event no extended color information should be transmitted from the control unit 11 and therefore the control unit would not provide such extended color select information. However, due to the operation of the present invention, this is not the case. The extended attribute and color select information is contemplated as passing through the microprocessor 15 and being stored in the extended memory section 26 of the screen RAM 24. In this manner the color display station 13 of the present invention will act as a fully compatible display station with an IBM 3274 control unit with IBM support configuration C even though electrical convergence signals are not utilized to control either the convergence of the CRT 14 or to affect, in any way, the visual display provided by the CRT 14.

It should be noted that all of the steps designated in the flowchart in FIGS. 2*a* and 2*b* which are to be implemented by the microprocessor control circuit 15 correspond to computer program subroutines or individual computer program steps which can be readily implemented by those of average skill in computer programming art. The decisions made by the MPU control circuit 15 can also be implemented by hardwired logic and comparison circuits if that is desired. In addition, changing the addresses of the convergence data received from control unit 11 to insure the storage of this data in the screen RAM could readily be implemented by a read only memory (ROM) circuit which would perform a table look-up function for the transmitted convergence data addresses received from the control unit 11, but allow the direct passage of the character information addresses which are intended to designate storage locations in the refresh memory screen RAM 24. Thus it would appear that all of the programming for the microprocessor control circuit 15 which is implemented by each of the steps in the flowchart in FIGS. 2*a* and 2*b* is readily within the capabilities of display system designers having average knowledge of the computer programming art. This is true especially when considering the extensive amount of literature that exists concerning the IBM 3270 information display system and the Hitachi and Motorola controller circuits utilized for the format controller 18, wherein this controller circuit literature also describes the operation of raster scan information systems that utilize multiplexers, refresh memory circuits, character generators and video control circuits similar to those described in the present invention.

While we have shown and described specific embodiments of the present invention, further modifications will occur to those of skill in the art. All such modifications which retain the basic underlying principles disclosed and claimed herein are within the scope of this invention.

We claim:

1. In a CRT information display system in which a CRT display station receives electrical convergence control signals from a control unit, effectively stores them and then allows the reading back of the stored convergence control signals, and in which a screen display RAM is provided for receiving and storing video character control signals which define a video character pattern to be visually displayed, the improvement comprising said display station including the combination of:

a preconverged CRT on which a video character pattern is to be displayed, means for receiving and storing said electrical convergence control signals in predetermined storage locations in said display station while preventing said stored convergence control signals from controlling convergence of said CRT, means for receiving and storing said video character control signals in predetermined storage locations in said screen RAM, and means for providing a predetermined visually displayed character pattern on said CRT in accordance with said stored video character control signals in said screen RAM while effectively preventing said stored convergence control signals from controlling convergence of said CRT.

2. The improvement according to claim 1 which includes means for effectively erasing said stored convergence control signals after receipt by said display station and prior to said display station receiving said video character control signals.

3. The improvement according to any of claims 1 or 2 in which said display station includes means for reading out said stored electrical convergence control signals prior to receipt by said display station of said video character control signals.

4. In a CRT information display system in which a CRT display station receives electrical convergence control signals from a control unit, effectively stores them and then allows the reading back of the stored convergence control signals, and in which a screen display RAM is provided for receiving and storing video character control signals which define a video character pattern to be visually displayed on a CRT, the improvement comprising the combination of:

means for receiving and storing said electrical convergence control signals in predetermined storage locations in said screen display RAM while preventing said stored convergence control signals from effectively defining a visually displayed character pattern, means for subsequently effectively erasing said convergence control signals stored in said screen RAM and receiving and storing said video character control signals in said predetermined storage locations in said screen RAM, and means for providing a predetermined visually displayed character pattern on said CRT in accordance with said stored video character control signals.

5. The improvement as recited in claim 4 which includes means for reading out said stored electrical convergence control signals stored in said screen RAM prior to the erasing of these stored signals and prior to the subsequent receipt and storing of said video character control signals in said screen RAM.

6. The improvement as recited in claim 5 wherein said means for providing said predetermined visually displayed character pattern includes a cathode ray tube (CRT) which is effectively connected to said screen display RAM to provide said visually displayed character pattern in accordance with said stored video character control signals, but is effectively disconnected from said screen display RAM during the time said RAM stores said electrical convergence control signals.

7. The improvement as recited in claim 6 wherein said CRT is effectively preconverged in accordance with preset controls and apparatus associated with said CRT, whereby said electrical convergence control signals are not utilized and not necessary for proper operation of said CRT.

8. The improvement as recited in claim 7 wherein said means for receiving and storing said electrical convergence control signals is enabled in response to effectively initially applying power to said display station and connecting said display station to a display video control unit which provides said electrical convergence control signals.

9. In a method for CRT information displaying system in which a CRT display station receives electrical convergence control signals from a control unit, effectively stores them and then allows the reading back of the stored convergence control signals, and in which a screen display RAM is provided in said display station for receiving and storing video character control signals which define a video character pattern to be visually displayed, the improved method comprising the steps of:

providing in said display station a preconverged CRT on which a video character pattern is to be displayed, receiving and storing said electrical convergence control signals in predetermined storage locations in said display station while preventing said stored convergence control signals from effectively controlling convergence of said CRT, subsequently receiving and storing said video character control signals in predetermined storage locations in said screen RAM, and providing a predetermined visually displayed character pattern on said CRT in accordance with said stored video character control signals in said screen RAM while effectively preventing said stored convergence control signals from controlling convergence of said CRT.

10. The improved method of claim 9 which includes the step of effectively erasing said stored convergence control signal subsequent to the receipt by said display station of these signals, but prior to the receipt by said display station of said video character control signals.

11. The improved method according to any of claims 9 or 10 which includes the step of reading out of said display station said stored electrical convergence control signals prior to said display station receiving said video character control signals.

12. In a method for CRT information displaying in which a CRT display station receives electrical convergence control signals from a control unit, effectively stores them and then allows the reading back of the stored convergence control signals, and in which a screen display RAM is provided in said display station for receiving and storing video character control signals which define a video character pattern to be visually displayed on a CRT in said display station, the improved method comprising the steps of:

receiving and storing said electrical convergence control signals in predetermined storage locations in said screen display RAM while preventing said stored convergence control signals from effectively defining a visually displayed character pattern, subsequently effectively erasing said convergence control signals stored in said screen RAM and receiving and storing said video character control signals in said predetermined storage locations in said screen RAM, and providing a predetermined visually displayed character pattern on said CRT in accordance with said stored video character control signals.

13. The improved method as recited in claim 12 which includes the step of reading out said stored electrical convergence control signals stored in said screen RAM prior to the erasing of these stored signals and prior to the subsequent receipt and storing of said video character control signals in said screen RAM.

14. The improved method as recited in claim 13 wherein said step for providing said predetermined visually displayed character pattern includes providing a cathode ray tube (CRT) which is effectively connected to said screen display RAM to provide said visually displayed character pattern in accordance with said stored video character control signals, said CRT being effectively disconnected from said screen display RAM during the time said RAM stores said electrical convergence control signals.

15. The improved method as recited in claim 14 wherein said provided CRT is effectively preconverged in accordance with preset controls and apparatus associated with said CRT, whereby said electrical convergence control signals are not utilized and not necessary for proper operation of said CRT.

16. The improved method as recited in claim 15 wherein said step of receiving and storing said electrical convergence control signals occurs in response to effectively initially applying power to said display monitor and connecting said display terminal to a display video control unit which provides said electrical convergence control signals.

* * * * *